United States Patent [19]

Smith et al.

[11] Patent Number: 4,866,884

[45] Date of Patent: Sep. 19, 1989

[54] LENS GRINDING METHODS AND APPARATUS

[75] Inventors: Kenneth L. Smith, Porum; Edgar L. Field, Jr., Muskogee, both of Okla.

[73] Assignee: Coburn Optical Industries, Inc., Tulsa, Okla.

[21] Appl. No.: 242,356

[22] Filed: Sep. 9, 1988

[51] Int. Cl.[4] ..... B24B 47/22; B24B 13/06

[52] U.S. Cl. ..... 51/284 R; 51/124 L; 51/165.79; 51/165.81

[58] Field of Search ..... 51/124 L, 106 LG, 105 LG, 51/101 LG, 165.79, 165.81, 284 R

[56] References Cited

U.S. PATENT DOCUMENTS 3,289,355 12/1966 Coburn et al. ..... 51/217 L

*Primary Examiner*—Robert P. Olszewski

*Assistant Examiner*—Jack W. Lavinder

*Attorney, Agent, or Firm*—Burns, Doane, Swecker & Mathis

[57] ABSTRACT

A lens grinding machine includes a grinding tool mounted on a tool support, and a lens holder mounted in a tailstock assembly. The lens is positioned for grinding by advancing the tailstock assembly into engagement with the tool support. A push-back member carried by a housing of the tailstock assembly is actuated to displace the tailstock housing to a predetermined spacing from the tool reference axis. A dial carried by the tailstock housing and operably connected to the lens holder is rotated to bring a desired lens thickness-related value on one scale into alignment with a lens diopter-related value on an adjacent scale, whereupon a precise grinding position of the lens is attained.

20 Claims, 2 Drawing Sheets

LENS GRINDING METHODS AND APPARATUS

BACKGROUND AND OBJECTS OF THE INVENTION

The present invention relates to methods and apparatus for positioning ophthalmic lenses for grinding and, in particular, for automatically situating a lens blank relative to a grinding tool.

A traditional technique for grinding ophthalmic lenses involves making repeated grinding passes across a lens blank by means of a rotary grinding cup until a required amount of the blank has been ground away, leaving a lens with a desired center thickness. The amount of the blank to be ground away can be calculated by subtracting the desired final thickness from original thickness.

In an effort to avoid the need for making calculations, a practice which is susceptible of error, a lens positioning technique was proposed in Coburn et al U.S. Pat. No. 3,289,355, issued Dec. 6, 1966 in which the positioning of a lens was achieved by the setting of a pair of dials in a manner avoiding the need for making calculations. In particular, that patent discloses a tool supporting assembly disposed opposite a tool grinding mechanism including a rotary grinding cup. The grinding mechanism is adjustable to properly orient the grinding cup for grinding a desired base curve and cross curve. The lens supporting mechanism is displaceable toward and away from the grinding mechanism and includes a stop for engaging the housing of the grinding mechanism. The stop is adjustable in location relative to the lens by means of a first dial which is calibrated by values corresponding to known lens diopter such that the stop is adjusted in accordance with the sagitta value of the lens, i.e., that portion of the lens thickness extending between the lens front curve and a lens reference plane defined by the lens holder. As a result of such an adjustment of the stop, the lens supporting mechanism can be initially displaced forwardly toward the grinding mechanism until the stop engages a cooperating abutment on the housing of the lens grinding mechanism, whereupon the lens reference plane will lie forwardly of a tool reference axis of the grinding mechanism by a distance equal to the sagitta value (S). The operator then sets a second dial which is calibrated in accordance with desired lens thickness to displace the lens holder rearwardly relative to the stop arm by a distance equal to the desired lens thickness (T). This dial adjustment is performed in step-by-step fashion following grinding sweeps of the tool. At the end of the movement of the second dial, i.e., when the dial reaches the desired thickness value, the lens reference plane will be spaced rearwardly of the tool reference axis by a distance equal to T-S which distance represents the amount of the lens which has been removed by the grinding tool in order to achieve the desired lens thickness.

In order for such a mechanism to produce sufficiently accurate lenses, it is necessary that the lens reference plane be precisely positioned relative to the tool reference axis at the end of the initial forward advancement of the lens supporting mechanism wherein the stop contacts the tool supporting mechanism. However, such precise positioning would be difficult to achieve in that system for a number of reasons. For example, the stop is disclosed as comprising at least three pivotably interconnected components, whereby there would be a considerable likelihood of relative play occurring between the components, and hence a positional inaccuracy of the stop.

Also, it is not uncommon for the lens supporting mechanism to rebound slightly when the stop engages the tool supporting mechanism, thereby creating a slight gap between the stop and the tool supporting mechanism. As a result, the location of the lens reference plane relative to the tool reference axis would be offset by a distance equal to such a gap, unbeknownst to the operator, and inaccuracies would occur in the grinding of the lens.

It would be desirable to enable a lens to be accurately ground to a desired thickness without the need for an operator to make calculations in advance of the grinding operation, or to take measurements of the lens during the grinding operation. It would also be desirable to enable a lens to be ground with minimal chance of dimensional inaccuracies occurring.

SUMMARY OF THE INVENTION

The present invention achieves this result by means of lens grinding methods and apparatus. A lens grinding machine is provided for grinding a first side of a lens blank disposed opposite a second convex side thereof having a front curve. The machine comprises a base and a grinding mechanism and a lens supporting mechanism supported on the base. The grinding mechanism includes an adjustable tool support defining a tool reference axis. The tool support is adapted to carry a grinding tool having an arcuate grinding edge and to guide the tool along a grinding path which intersects the tool reference axis. The lens supporting mechanism is mounted opposite the grinding mechanism and includes a tailstock assembly having a tailstock housing movable in a fore-to-aft direction of movement toward and away from the tool support. The tail stock assembly includes a lens holder mounted on the tailstock housing for movement therewith and being movable relative to the tailstock housing in the direction of movement. The lens holder defines a lens reference plane disposed substantially perpendicular to the direction of movement and substantially parallel to the tool reference axis. The lens holder is adapted to support a lens such that the first side thereof faces the grinding mechanism. A mechanism is provided for moving the tailstock assembly in the direction of movement to bring the tailstock assembly into engagement with the tool support. The tailstock assembly includes a manually actuable push-back mechanism mounted on the tailstock housing. The push-back mechanism comprises a push-back member acting between the tool support and the tailstock housing for pushing the tailstock housing away from the tool reference axis to a predetermined spacing therefrom. The tailstock assembly includes a calibrated dial operably connected to the lens holder for displacing the lens holder relative to the tailstock housing. The dial comprises a first scale which is movable relative to a second scale disposed on the tailstock housing. One of the first and second scales is calibrated in relation to a diopter of the lens second side, and the other of the first and second scales is calibrated in relation to a desired lens thickness. The dial means is movable to position a desired thickness-related value on the one scale in alignment with a diopter-related value on the other scale, whereby with the tailstock housing disposed at the predetermined spacing from the tool reference axis, the lens reference plane is spaced from the tool reference axis by a distance suitable for grinding the lens first side to establish the desired lens thickness.

The present invention also includes method aspects of positioning and grinding a lens in accordance with the above.

THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
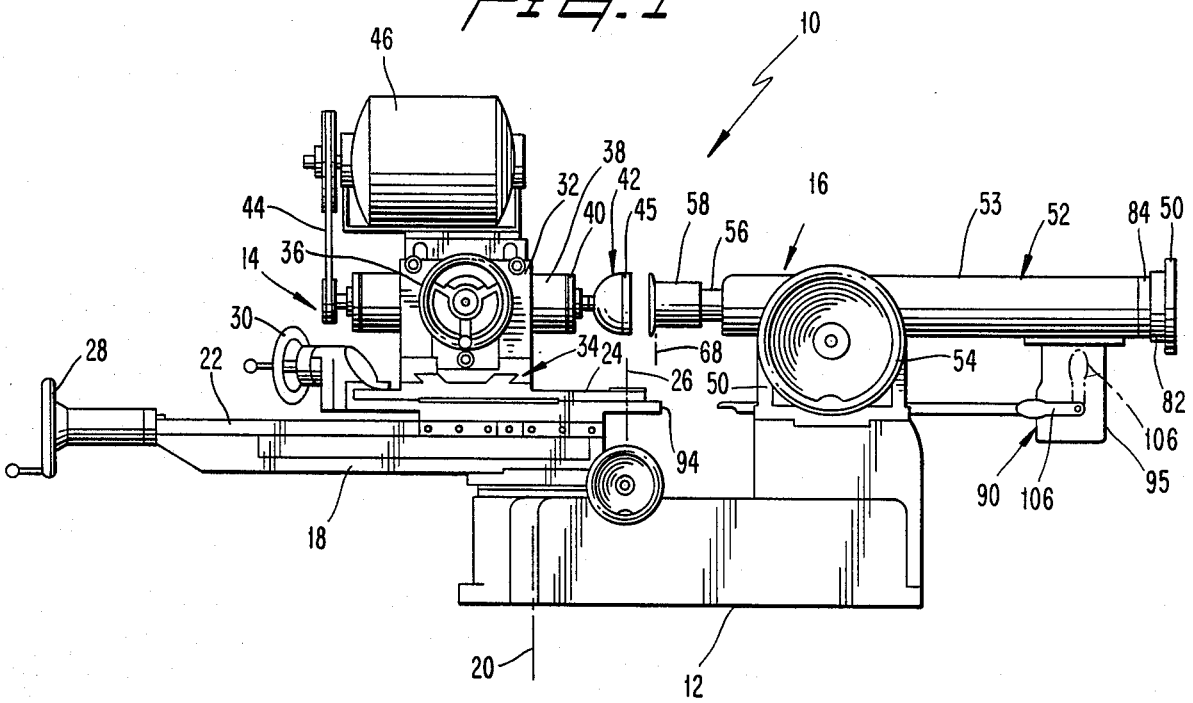
FIG. 1 is a side elevational view of a lens grinding machine in accordance with the present invention.
Figure 2:
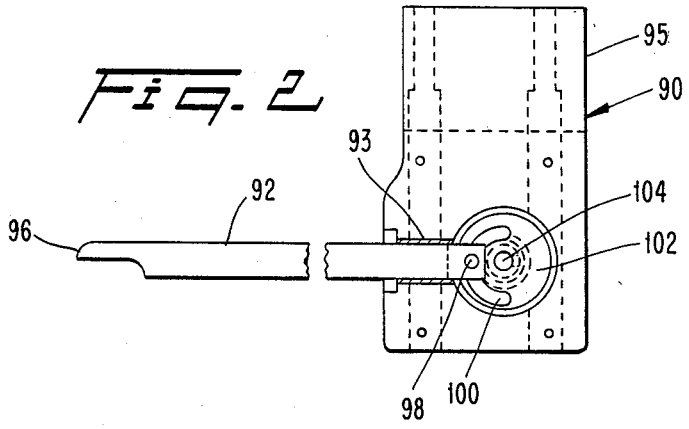
FIG. 2 is a side elevational view of a push-back mechanism according to the present invention, with a push-back arm thereof in a forwardmost position of adjustment.

A preferred automatic lens grinding machine 10 comprises a base 12 on which are mounted a tool supporting mechanism 14 and a lens supporting mechanism 16. The tool supporting mechanism is similar to that described in U.S. Pat. Nos. 2,806,327 and 3,289,355, the disclosures of which are incorporated by reference herein. Basically, the tool supporting mechanism 14 comprises a plate 18 which is pivotably mounted to the base 12 for rotation about a vertical axis 20. Slidably mounted on a horizontal surface of the plate 18 is a tool support comprising a base curve slide 22, and a cross curve slide 24 pivotably mounted to the base curve slide for rotation about a vertical axis 26 defined by a pin 27. The base curve slide can be adjusted horizontally relative to the plate 18 in a fore-to-aft direction toward and away from the lens supporting mechanism by means of a conventional hand wheel adjustment 28. The cross curve slide 24 can be adjusted relative to the base curve slide 22 about the axis 26 by means of a conventional hand wheel adjustment 30.

Mounted on the cross curve slide 24 is a bearing block 32 which is adapted to slide horizontally relative to the cross curve slide in a direction perpendicular to the fore-to-aft direction. This is achieved by mounting the bearing block 32 by means of a dove-tail track 34 and providing a conventional hand-wheel adjustment 36.

A spindle housing 38 mounted in the bearing block 32 rotatably carries a shaft 40 on one end of which a grinding tool 42 is supported. The opposite end of the shaft is driven by a belt drive 44 from a motor 46 resting atop the bearing block.

The tool 42 is cup-shaped and presents a curved cutting edge 45. The curved edge is rounded as viewed in cross-section so as to define a center of curvature spaced from the plane of the curved edge. The arrangement of the bearing block and spindle housing is such that the vertical axis 26 is intersected by that center of curvature during each grinding sweep of the tool. The axis 26 thus defines a tool reference axis. The grinding sweep of the tool is effected by oscillating the tool supporting mechanism 14 about the vertical axis 20 after the tool 42 has been properly positioned through appropriate adjustments of the wheels 28, 30 and 36.

The lens supporting mechanism 16 comprises a support block 50 on which a tailstock assembly 52 is slidably supported. The tailstock 52 includes a housing 53 which can be reciprocated in a horizontal fore-to-aft direction by a conventional adjustment wheel 54. A shaft 56 is mounted in the tailstock for reciprocable movement relative to the housing 53 in the fore-to-aft direction.

A front end of the shaft 56 carries a lens holder in the form of a conventional chuck 58. The chuck includes a space ring 60 into which a blocked lens 62 is inserted such that a so-called "front curve" 64 of the lens abuts against a front surface 66 of the space ring. That surface defines a vertical lens reference plane 68 disposed perpendicular to the fore-to-aft direction of movement of the shaft 56 and parallel to the tool reference axis 26.

The portion of the thickness S of the lens 62 disposed rearwardly of the lens reference plane 68 (i.e., to the right of the plane 68 in FIG. 4) is known as the "sagitta" value. The desired thickness T of the lens comprises the sagitta S plus the portion of the desired thickness disposed forwardly of the lens reference plane 68 (i.e., to the left of the plane 68 in FIG. 4), which portion can be defined as T-S. Thus, the front-facing surface 70 of the lens must be ground away until the remaining portion of the lens disposed forwardly of the lens reference plane 68 equals T-S. The manner in which such a positioning of the lens is achieved will now be explained.

Operably connected to the shaft 56 is a calibrated dial 80. The dial is connected such that rotation of the dial produces movement of the shaft 56 in the fore-to-aft direction. The dial carries a first scale 82 disposed adjacent a second scale 84 disposed on the housing 53, whereby the first scale is rotatable relative to the second scale.

Figure 4:
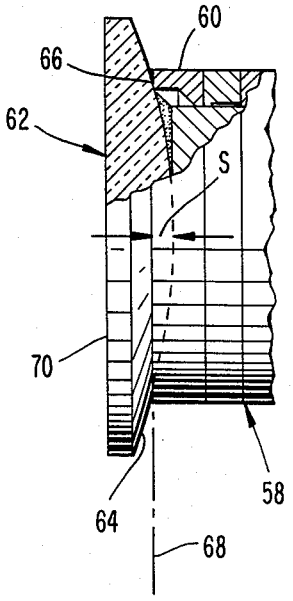
FIG. 4 is a fragmentary side view, partially broken-away, a lens mounted in a lens chuck.

The first scale 82 is calibrated in accordance with lens thickness, whereas the second scale 84 is calibrated in accordance with lens diopter, i.e., the diopter of the front curve 70 of the lens 62 (see FIG. 4). When a lens is to be ground, the operator is presented with both the diopter value of the front curve and the desired lens thickness. Since the diopter value is a function of the sagitta S of the lens, the diopter scale can be arranged such that by aligning the desired lens thickness value on the scale 82 with the lens diopter value on the scale 84, the shaft 56 is displaced by a distance corresponding to the desired thickness minus the sagitta, i.e., by a distance (T-S).

Figure 6:
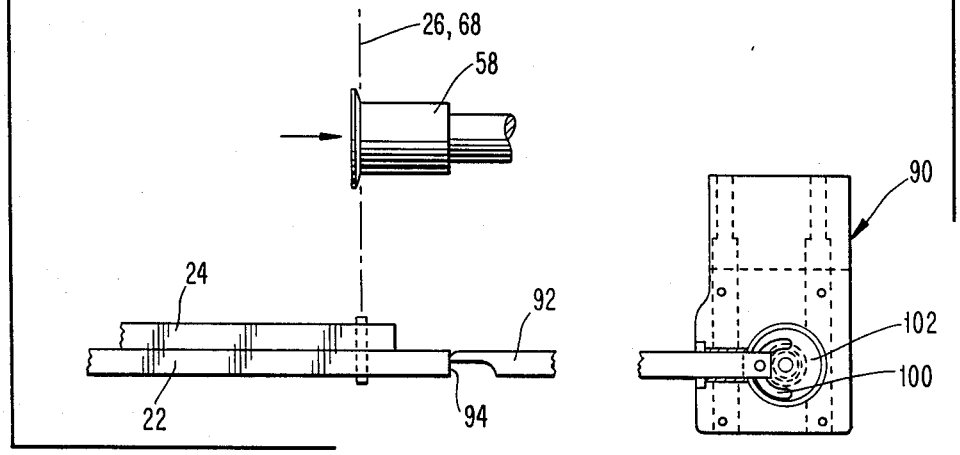
FIG. 6 is a view similar to FIG. 5 depicting the relationship of the lens reference plane and the tool reference axis following actuation of the push-back mechanism.
Figure 7:
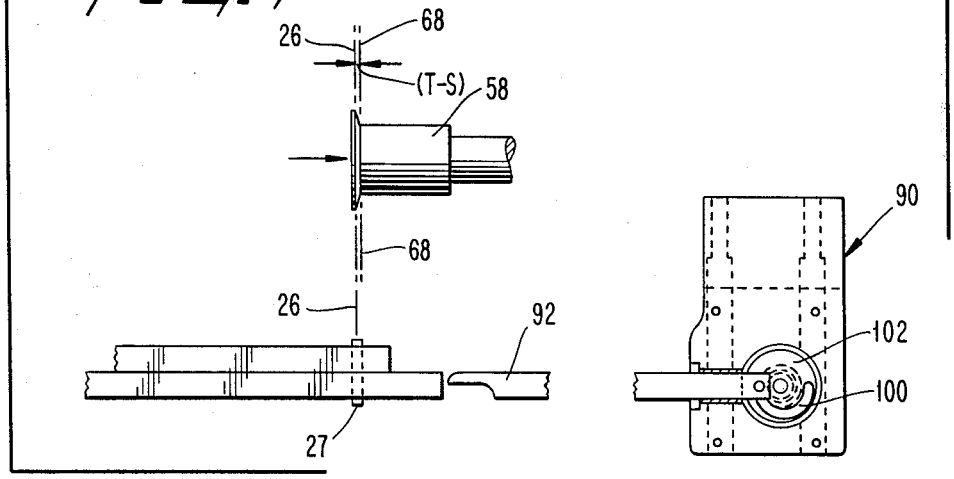
FIG. 7 is a view similar to FIG. 5 depicting the relationship between the lens reference plane and the tool reference axis following actuation of a calibrated dial to locate the lens in a final position of grinding.

It will thus be appreciated that if the shaft 56 would be positioned with the tool reference axis 26 lying in the lens reference plane 68 (FIG. 6), then by rotating the dial 80 to align the desired thickness value with the lens diopter value, the lens would be displaced rearwardly by a distance T-S which assures that following the grinding of the lens, there would remain only (1) the portion thereof disposed forwardly of the plane 68 (i.e., thickness T-S) and (2) the portion thereof disposed rearwardly of the plane 68 (i.e., thickness S). Thus T-S+S equals T, i.e., the desired thickness.

The dial arrangement 80, 82, 84 is per se conventional. However, up until now it has not been used on a grinding machine of this type, because of the difficulties encountered in precisely positioning the tool reference axis 26 relative to the lens reference plane 68, for reasons noted earlier herein in the Background section. Due to those difficulties, the practice has been to calculate the amount of lens thickness to be ground away, then bring the lens into contact with the tool, and thereafter set a sliding dial to indicate the amount to be cut away. This practice is time-consuming and susceptible to error.

However, as explained below, the present invention enables the lens to be positioned such that the tool reference axis 26 is precisely positioned relative to the lens reference plane 68 so that the dial 80, 82, 84 can be utilized in conjunction with the shaft 56 to enable the lens to be ground to its final thickness as a result of simple manipulations by the operator which are quicker and less susceptible to error than has previously been the case.

The preferred mechanism for achieving a precision positioning of the lens reference plane 68 relative to the tool reference axis 26 comprises a manually actuable push-back mechanism 90. That mechanism includes a push-back arm 92 which is carried by the tailstock housing 53 and extends toward an abutment surface 94 of the base curve plate 22. Thus, the push-back arm 92 travels forwardly with the tailstock housing 53 when the latter is moved forwardly in response to actuation of the adjustment wheel 54, such that a front end 96 of the arm 92 will engage the abutment surface 94.

A rear end of the push-back arm 92 extends through a sleeve 93 disposed in a casing 95, which casing is fastened to the tailstock housing. The arm 92 carries a pin 98 which is movably disposed within an arcuate slot 100 formed in a rotary cam element 102. The cam element is mounted in the casing 95 for rotation about an axle 104. The slot 100 is eccentrically arranged relative to the axis of rotation of the cam element 102. The axle 104 is connected to the cam element 102 and to a manual actuating handle 106 (FIG. 1). In response to actuation of the handle to rotate the cam element 102 by a prescribed amount, e.g., 90° from a rest position, the spacing between the pin 98 and the axle 104 will be changed by a distance D. Thus, in the event that the front end 96 of the arm 92 was freely movable during such rotation of the cam element from the rest position depicted in FIG. 3, the arm 92 would be displaced forwardly by distance D. On the other hand, if the front end of the arm 92 was in engagement with the abutment surface 94 of the stationary base curve plate, then rotation of the cam element from the rest position would cause the tailstock housing to be pushed rearwardly away from the abutment surface 94 by a distance D.

Figure 3:
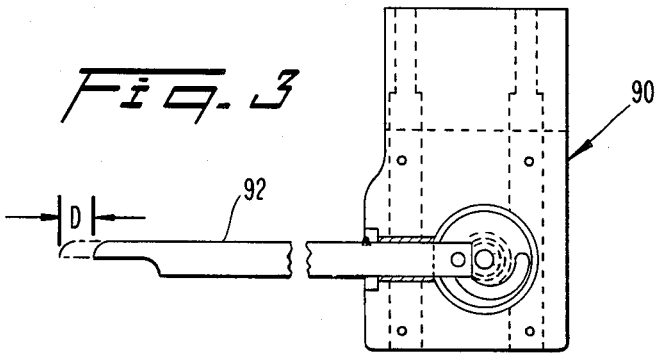
FIG. 3 is a view similar to FIG. 2 with the push-back arm disposed in a rearwardmost position of adjustment.

The cam element 102 is preferably spring-biased, by a torsion spring or the like, to the rest position of FIG. 3 and will thus occupy that position whenever the handle 106 is released.

The manner in which the push-back mechanism enables the position of the lens reference plane to be precisely controlled relative to the tool reference axis will now be described.

Figure 5:
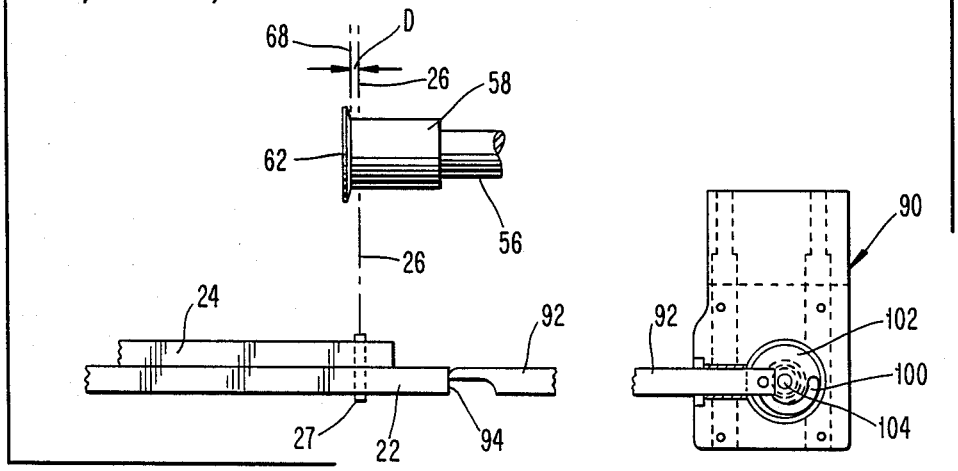
FIG. 5 is a schematic view depicting the relative positions between the lens reference plane and the tool reference axis before actuation of the push-back mechanism.

After a grinding tool 42 has been installed in the tool supporting mechanism 14 and oriented in a proper cutting position by adjustment of the base curve slide 22, the cross curve slide 24, and the spindle block 32, and after a blocked lens 62 has been mounted in the tailstock 52, the tailstock is advanced by adjustment of the wheel 54 until the push-back arm 92 abuts against the abutment surface 94 of the base curve slide 22, as depicted in FIG. 5. Assuming that the dial 80 is set on zero, the lens reference axis will be situated forwardly of the tool reference axis 26 (i.e., to the left of the axis 26 as viewed in FIG. 5). By then actuating the handle 106 to rotate the cam element 102, the push-back arm 92 will be displace by distance D relative to the tailstock housing 53. Since the arm 92 abuts the immovable surface 94, the arm 92 will remain stationary and the tailstock will be displaced rearwardly by a distance D. Assuming that the dial 80 is still set on zero, the tool reference axis 26 will lie precisely in the lens reference plane 68. At this point, it is merely necessary to rotate the dial 80 to set the lens desired thickness value opposite the lens front-curve diopter value on the scale 84, whereupon the lens reference axis will be displaced by a distance T-S (i.e., desired thickness minus sagitta) as explained earlier herein. Accordingly, the lens will be disposed precisely in a position corresponding to the final cutting stroke of the tool.

Of course, no cuts have yet been made; the foregoing description has been made to illustrate the behavior of the lens reference axis during operation of the push-back mechanism. The alignment of the desired lens thickness value on the dial scale 82 with the diopter value on the adjacent scale 84 constitutes a final grinding position for establishing the desired lens thickness. During an actual cutting operation, however, the operator would advance the dial 80 in step-by-step fashion toward such a final grinding position to enable the cutting to proceed by means of successive strokes of the tool (i.e., the dial 80 would be turned step-by-step toward the diopter value on scale 84). In fact, during an actual initial advancement of the tailstock toward the tool support mechanism to effect engagement between the push-back arm and the abutment surface, the dial would be set to an excessively high setting in order to assure that the lens does not contact the grinding tool. In other words, in practice, the lens reference plane need never reach the tool reference axis during the initial advancement of the tailstock.

Thus, it will be appreciated that during the pushing back of the tailstock to its predetermined spacing from the tool reference axis by the arm 92, the setting on the dial 80 is irrelevant as regards a proper positioning of the lens. Once the tailstock has been properly pushed-back, a rotation of the dial from any initial setting to a setting aligning the desired thickness value with the relevant diopter value will automatically position the lens in its final grinding position. It will be understood that this result can be achieved without any need for the operator to make calculations or measure the lens thickness during any phase of the setting or grinding procedures.

These advantages are made possible by the precise positioning of the lens reference plane 68 relative to the tool reference axis 26 upon the initial advancement of the tailstock. Such precision is assured even if the push-back arm 92 is not in contact with the abutment surface 94 at the end of the tailstock advancement step. That is, referring to FIG. 5, even if the push-back arm 92 were to have rebounded slightly away from the surface 94 when initial contact occurred therebetween, i.e., such that a slight gap (not shown) is formed between the front end 96 of the arm 92 and the abutment surface 94, the position of the lens reference plane following the push-back step will not be affected, because during the push-back step the arm 92 will travel forwardly until it engages the abutment surface and will then proceed to push the tailstock rearwardly. (This assumes that the gap size is no greater than the distance D, but the creation of such a large gap is easily avoidable by taking no more than reasonable care during advancement of the tailstock.)

Thus, the final position of the lens reference plane 68 relative to the tool reference axis 26 will not be affected even by the presence of a small gap between the arm 92 and the surface 94 following the initial advancement of the tailstock. Note also that since the stop arm comprises a one-piece member, the chances for erroneous results to occur as a result of relative play (as could result if the arm was instead formed of a plurality of pivotably interconnected parts) are minimized.

It will be understood that it is not necessary that the push-back arm itself perform the function of stopping the advancement of the tailstock. Rather, a separate fixed stop member on the tailstock could be employed for that purpose, with the front end of the push-back arm disposed slightly rearwardly of the stop member. In such a case, the push-back arm would only contact the tool supporting mechanism during actuation of the cam element during a push-back step.

It will be appreciated, then, that the present invention enables a lens-grinding operation to be carried out by a simplified procedure which reduces the chances for error. A precise positioning of the lens reference plane relative to the tool reference axis can be easily achieved, even if the initial advancement of the tailstock results in the creation of a slight gap between the arm 92 and the surface 94. Furthermore, the advancement of the lens during the actual grinding operation is achieved without the need for making calculations, or measuring the lens. Rather, it is merely necessary for the operator to advance a single dial in step-by-step fashion until the desired thickness value is aligned with the diopter value.

Although the present invention has been described in connection with a preferred embodiment of the invention, it will be appreciated by those skilled in the art that modifications, additions, substitutions and deletions not specifically described may be made without departing from the spirit and scope of the invention as defined in the appended claims.

What is claimed is:

1. A lens grinding machine for grinding a first side of a lens blank disposed opposite a second convex side thereof having a front curve, said machine comprising:

a base;

a grinding mechanism mounted on said base and including an adjustable tool support defining a tool reference axis, said tool support adapted to carry a grinding: tool having an arcuate grinding edge and to guide the tool along a grinding path which intersects said tool reference axis; and a lens supporting mechanism mounted on said base opposite said grinding mechanism and including:

a tailstock assembly having a tailstock housing movable in a fore-to-aft direction of movement toward and away from said tool support;

said tailstock assembly including a lens holder mounted on said tailstock housing for movement therewith and being movable relative to said tailstock housing in said direction of movement, said lens holder defining a lens reference plane disposed substantially perpendicular to said direction of movement and substantially parallel to said tool reference axis, said lens holder adapted to support a lens such that said first side thereof faces said grinding mechanism;

means for moving said tailstock assembly in said direction of movement to bring said tailstock assembly into engagement with said tool support, said tailstock assembly including manually actuable push-back means mounted on said tailstock housing, said push-back means comprising a push-back member acting between said tool support and said tailstock housing for pushing said tailstock housing away from said tool reference axis to a predetermined spacing therefrom;

said tailstock assembly including calibrated dial means operably connected to said lens holder for displacing said lens holder relative to said tailstock housing, said dial means comprising a first scale which is movable relative to a second scale disposed on said tailstock housing, one of said first and second scales being calibrated in relation to a diopter of said lens second side, and the other of said first and second scale being calibrated in relation to a desired lens thickness, said dial means being movable to position a desired thickness-related value on said one scale in alignment with a diopter-related value on said other scale, whereby with said tailstock housing disposed at said predetermined spacing from said tool reference axis, said lens reference plane is spaced from said tool reference axis by a distance suitable for grinding said lens first side to establish said desired lens thickness.

2. A lens grinding machine according to claim 1, wherein said push-back member constitutes a stop arm for engaging an abutment surface on said tool support to terminate advancement of said tailstock assembly toward said tool support.

3. A lens grinding machine according to claim 1, wherein said push-back member comprises an arm movably mounted on said tailstock housing, and manually actuable displacement means for displacing said arm.

4. A lens grinding machine according to claim 3, wherein said displacement means comprises a manually rotatable cam element operably connected to said arm.

5. A lens grinding machine according to claim 4, wherein said cam element includes an eccentric slot, a rear end of said arm carrying a pin slidably received in said slot.

6. A lens grinding machine according to claim 5, wherein said arm is constrained for reciprocal movement in said fore-to-aft direction.

7. A lens grinding machine according to claim 6, wherein said arm constitutes a stop for engaging an abutment surface on said tool support for terminating advancement of said tailstock assembly toward said tool support.

8. A lens grinding machine according to claim 5, wherein said slot is elongated in a direction perpendicular to an axis of said pin.

9. A lens grinding machine according to claim 5, wherein said pin extends in a first direction and is movable in said slot in a second direction perpendicular to said first direction.

10. A lens grinding machine according to claim 5, wherein said slot extends along an arcuate path eccentrically disposed with respect to an axis of rotation of said cam element.

11. A lens grinding machine according to claim 1, wherein said lens thickness scale is rotatably mounted relative to said diopter scale and said diopter scale is disposed on said lens holder.

12. A lens grinding machine according to claim 1, wherein said first scale confronts said second scale, said first scale having markings respectively representing desired lens thickness values and said second scale having markings respectively representing lens diopter values, said dial means being set by aligning one of said thickness value markings with one of said lens diopter markings.

13. A lens grinding machine according to claim 1, wherein said calibrated dial means comprises a rotatable dial carrying said first scale, said first scale being coaxial with said second scale.

14. A method of grinding a first side of a lens blank disposed opposite a second convex side thereof having a front curve, said method comprising the steps of:

mounting in a tool support a grinding tool having an arcuate grinding edge, said tool being movable along a grinding path which intersects a tool reference axis defined by said tool support, mounting said lens in a lens holder carried by a housing of a tailstock assembly such that said first side of said lens faces said tool, said lens holder defining a lens reference plane disposed substantially parallel to said tool reference axis, advancing said tailstock assembly in a direction of movement substantially perpendicular to said lens reference plane to bring said tailstock assembly into engagement with said tool support, manually displacing a push-back member of said tailstock assembly which acts between said tool support and said tailstock housing to displace said tailstock housing to a predetermined spacing from said tool reference axis, and grinding a lens by actuating a calibrated dial carried by said tailstock housing and operably connected to said lens holder to displace said lens holder relative to said tailstock housing, said dial containing a first scale which is movable relative to a second scale on said tailstock housing, one of said first and second scales being calibrated in relation to a diopter of said lens second side, and the other of said first and second scales being calibrated in relation to a desired thickness of said lens, said first scale being movable relative to said second scale to position a diopter-related value of said one scale in alignment with a thickness-related value of said second scale, whereby with said tailstock housing disposed at said predetermined spacing from said tool reference axis, said lens reference plane is spaced from said tool reference axis by a distance suitable for grinding said lens first side to establish said desired lens thickness.

15. A method according to claim 14, wherein said advancing step comprises advancing said tailstock assembly until a front end of said push-back member engages an abutment surface of said tool support.

16. A method according to claim 14, wherein said manually displacing step comprises displacing said push-back member by rotating a cam element carried by said tailstock housing and operably connected to said push-back member.

17. A method according to claim 14, wherein said step of moving said first scale relative to said second scale comprises rotating said dial.

18. A method according to claim 14, wherein said manually displacing step comprises displacing said tail stock housing away from said push-back member by means of a cam member which presses a part of said push-back member in contact with a part of said tool support.

19. A method according to claim 14, wherein said manually displacing step comprises pressing said push-back member against said tool support while pressing said tail stock housing against said push-back member to displace said housing to said predetermined distance from said tool reference axis.

20. A lens grinding machine for grinding a first side of a lens blank disposed opposite a second convex side thereof having a front curve, said machine comprising:

a base;

a grinding mechanism mounted on said base and including an adjustable tool support defining a tool reference axis, said tool support adapted to carry a grinding tool having an arcuate grinding edge and to guide the tool along a grinding path which intersects said tool reference axis; and a lens supporting mechanism mounted on said base opposite said grinding mechanism and including:

a tailstock assembly having a tailstock housing movable in a fore-to-aft direction of movement toward and away from said tool support;

said tailstock assembly including a lens holder mounted on said tailstock housing for movement therewith and being movable relative to said tailstock housing in said direction of movement, said lens holder defining a lens reference plane disposed substantially perpendicular to said direction of movement and substantially parallel to said tool reference axis, said lens holder adapted to support a lens such that said first side thereof faces said grinding mechanism;

means for moving said tailstock assembly in said direction of movement to bring said tailstock assembly into engagement with said tool support;

said tailstock assembly including manually actuable push-back means mounted on said tailstock housing, said push-back means comprising a push-back member acting between said tool support and said tailstock housing for pushing said tailstock housing away from spacing therefrom;

said tailstock assembly including a mechanism operably connected to said lens holder for displacing said lens holder relative to said tailstock housing, said mechanism comprising a first scale which is calibrated in relation to a diopter of said lens second side and a second scale which is calibrated in relation to a desired lens thickness, said mechanism being movable to position a desired thickness-related value on said one scale and a diopter-related value on said other scale, whereby said lens reference plane can be spaced from said tool reference axis by a distance suitable for grinding said lens first side to establish said desired lens thickness.

* * * * *